US009903201B2

(12) United States Patent
Mitterndorfer

(10) Patent No.: US 9,903,201 B2
(45) Date of Patent: Feb. 27, 2018

(54) CUTTING TOOL SYSTEM

(71) Applicant: Thomas Mitterndorfer, Sharpsburg, MD (US)

(72) Inventor: Thomas Mitterndorfer, Sharpsburg, MD (US)

(73) Assignee: Antraquip Corporation, Hagerstown, MD (US)

( * ) Notice: Subject to any disclaimer, the term of this patent is extended or adjusted under 35 U.S.C. 154(b) by 163 days.

(21) Appl. No.: 14/966,178

(22) Filed: Dec. 11, 2015

(65) Prior Publication Data

US 2017/0167258 A1 Jun. 15, 2017

(51) Int. Cl.
*E21C 27/22* (2006.01)
*E21B 3/00* (2006.01)

(52) U.S. Cl.
CPC ..... *E21C 1/00* (2013.01); *E21C 27/22* (2013.01)

(58) Field of Classification Search
CPC ..... E21C 27/22
USPC ..... 299/41.1, 53, 78, 79.1, 55; 464/182, 137
See application file for complete search history.

(56) References Cited

U.S. PATENT DOCUMENTS

| | | | | |
|---|---|---|---|---|
| 1,893,033 | A | 1/1933 | Murdock et al. | |
| 2,180,120 | A | 11/1939 | Saltzer | |
| 2,249,162 | A | 7/1941 | Nielsen | |
| 2,955,804 | A | 10/1960 | Feucht | |
| 5,607,023 | A * | 3/1997 | Palm | B23D 49/162 173/178 |
| 6,374,916 | B1 | 4/2002 | Laflin | |
| 6,516,904 | B1 | 2/2003 | Rein, Sr. et al. | |
| 9,046,204 | B2 | 6/2015 | Surveyor et al. | |

* cited by examiner

*Primary Examiner* — Sunil Singh
(74) *Attorney, Agent, or Firm* — Berenato & White, LLC

(57) ABSTRACT

A cutting tool system is provided that includes a locking collar and a bit attachment member. The locking collar is compressible radially inwardly and has a tapering outer surface. The bit attachment member has a tapering inner surface constructed to receive and interface with the outer surface of the locking collar. According to an embodiment, a first groove in the outer surface of the locking collar is alignable with a second groove of the bit attachment member to form a perimeter of a pin receptacle in which is pin is insertable to prevent relative rotation between the locking collar and the bit attachment member. According to another embodiment, the cutting tool system further includes a retainer plate and fasteners constructed to secure the retainer plate directly to the locking collar and to the driving shaft, and to cause inward compression of the locking collar.

13 Claims, 12 Drawing Sheets

CUTTING TOOL SYSTEM

FIELD OF THE INVENTION

The present invention relates to a cutting tool system, including a cutter head (also known as cutter drum) useful in mining and tunneling applications, and related methods.

BACKGROUND OF THE INVENTION

Rotating cutting devices used in mining and tunneling applications typically include a cutting head mounted on a driving shaft through which power is transmitted. Because the cutting tool head is subject to repeated impact blows in the course of normal operating conditions, gaps can develop between mating parts, resulting in a rocking motion. Repeated impact blows leads to the deterioration of the parts in a relatively short amount of time. Once damaged, the parts can be virtually impossible to repair, and the parts or the cutting head in its entirety must be replaced, which leads to machine and production downtimes and loss of efficiency and profitability.

SUMMARY OF THE INVENTION

A first aspect of the invention provides a cutting tool system including a locking collar, a bit attachment member, and a pin. The locking collar has a socket configured to mate with a driving shaft in locking engagement to prevent relative rotational movement between the locking collar and the driving shaft. The locking collar further has a radially outwardly facing outer surface including a substantially longitudinally extending first groove. The bit attachment member has a radially inwardly facing inner surface including a substantially longitudinally extending second groove that is alignable with the first groove so that the first and second grooves together form a perimeter of a pin receptacle. The pin is insertable into the pin receptacle to prevent rotation of the locking collar and the bit attachment member relative to one another.

According to a second aspect of the invention, a cutting tool system is provided that includes a locking collar, a bit attachment member, a retainer plate, and fasteners. The locking collar has a socket configured to mate with a driving shaft in locking engagement to prevent relative rotational movement between the locking collar and the driving shaft. The locking collar is compressible radially inwardly and has a radially outwardly facing outer surface tapering in a longitudinal direction along at least a portion thereof at a first tapering angle. The bit attachment member has a radially inwardly facing inner surface tapering along at least a portion thereof at a second tapering angle that is approximately equal to the first tapering angle to interface with the tapering outer surface of the locking collar. The fasteners are constructed to secure the retainer plate directly to the locking collar and to the driving shaft, and to impart a wedging action between the tapering outer surface and the tapering inner surface that causes inward compression of the locking collar.

A third aspect of the invention provides a cutting tool system that includes a locking collar, a bit attachment member, a pin, a retainer plate, and fasteners. The locking collar has a socket configured to mate with a driving shaft in locking engagement to prevent relative rotational movement between the locking collar and the driving shaft. The locking collar is compressible radially inwardly and has a radially outwardly facing outer surface tapering in a longitudinal direction along at least a portion thereof at a first tapering angle. The outer surface includes a substantially longitudinally extending first groove. The bit attachment member has a radially inwardly facing inner surface tapering along at least a portion thereof at a second tapering angle that is approximately equal to the first tapering angle to interface with the outer surface of the locking collar and permit inward compression of the locking collar. The inner surface includes a substantially longitudinally extending second groove that is alignable with the first groove so that the first and second grooves together form a perimeter of a pin receptacle in which the pin is insertable to prevent rotation of the locking collar and the bit attachment member relative to one another. The fasteners are constructed to secure the retainer plate directly to the locking collar and to the driving shaft, and to impart a wedging action between the tapering outer surface and the tapering inner surface that causes inward compression of the locking collar.

The above aspects and embodiments may be combined and practiced with one another in any combination, including in combination with further exemplary embodiments described below and illustrated in the drawings.

Other aspects and embodiments of the invention, including assemblies, components, apparatus, kits, methods and processes of making and using, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain principles of the invention. In such drawings.

Figure 1A:
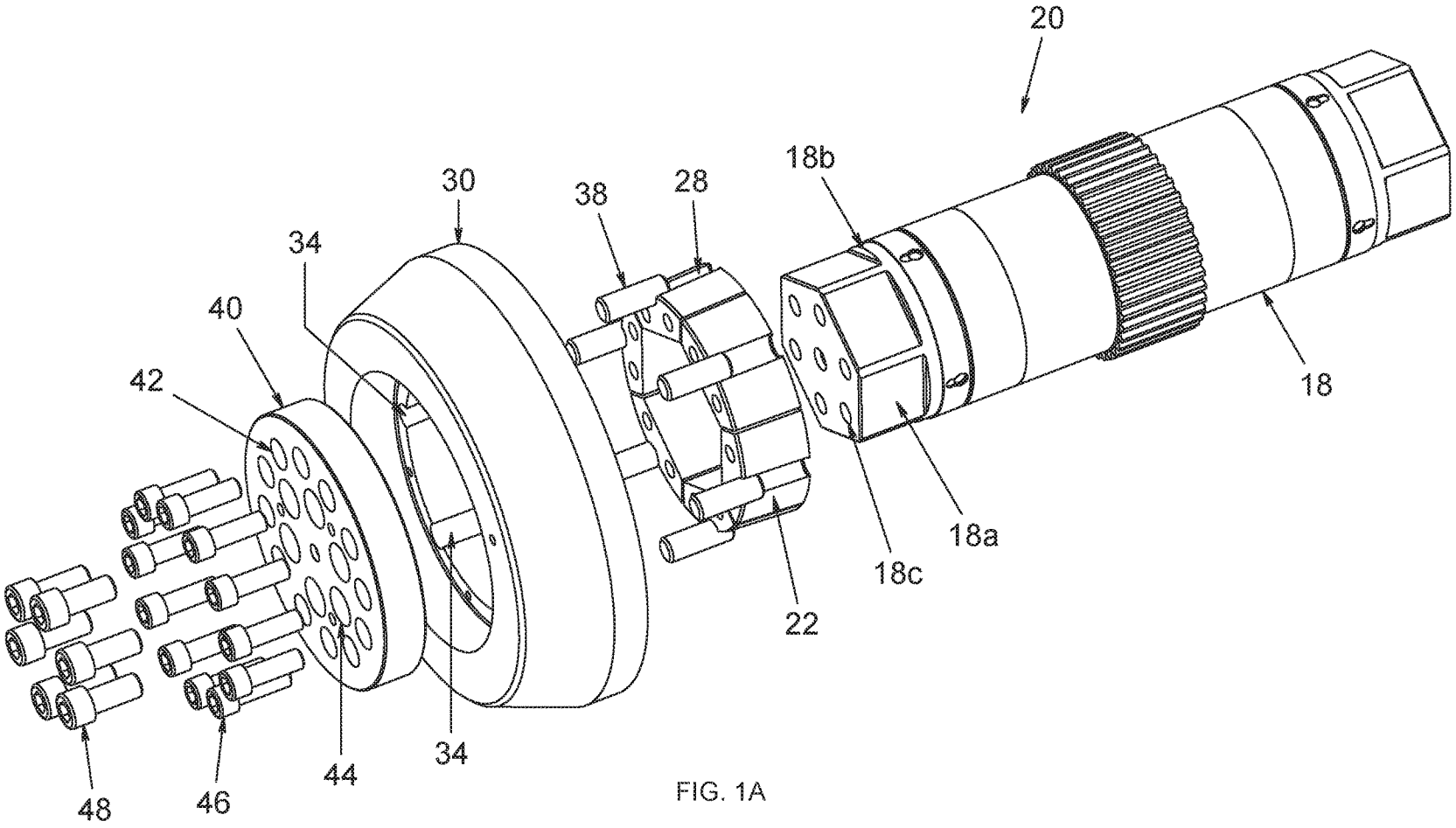
FIG. 1A is an exploded assembly view of a cutting tool system in relation to a driving shaft.

DETAILED DESCRIPTION OF EXEMPLARY EMBODIMENTS AND EXEMPLARY METHODS OF THE INVENTION

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative components, materials, methods, and illustrative examples shown and described in connection with the exemplary embodiments and methods.

A cutting tool system, and in particular a cutting tool head assembly embodied as a cutter head or cutter drum, in a disassembled state, is generally designated by reference numeral 20 in FIG. 1A. The cutting tool system 20 is shown in relation to a drill driving shaft 18, which rotates about its axis at high speeds in a manner known in the art. The driving shaft 18 is illustrated with a head 18*a* at one end. The head 18*a* has a slightly decreased diameter or thickness to define a shoulder or ledge 18*b*.

The cutting tool system 20 includes an annular locking collar 22 having a socket configured to mate with the head 18*a* of the driving shaft 18 in locking engagement to prevent relative rotation between the locking collar 22 and the driving shaft 18. In the illustrated embodiment, the radially inwardly facing inner surface 23 of the locking collar 22 has a hexagonal configuration from the perspective of the plan views of FIGS. 2 and 3 to establish a socket matching the hexagonal shape of the head 18*a* of the driving shaft 18. When the cutting tool system 20 is mounted on the driving shaft 18, each facet of the socket of the locking collar 22 engages a corresponding facet of the head 18*a* of the driving shaft 18 to prevent relative rotation between the locking collar 22 and the driving shaft 18 during operation. It should be understood that the socket of the locking collar 22 and the head 18*a* of the driving shaft 18 may undertake other shapes, especially other polygons such as squares and rectangles.

Figure 2:
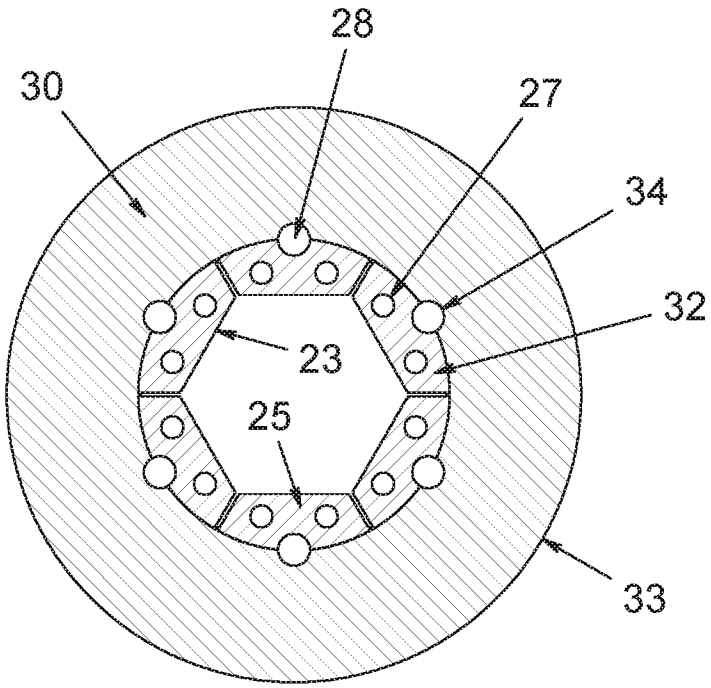
FIG. 2 is a plan view of a locking collar and a bit attachment member of the cutting tool system of FIGS. 1A and 1B without a retainer plate.
Figure 3:
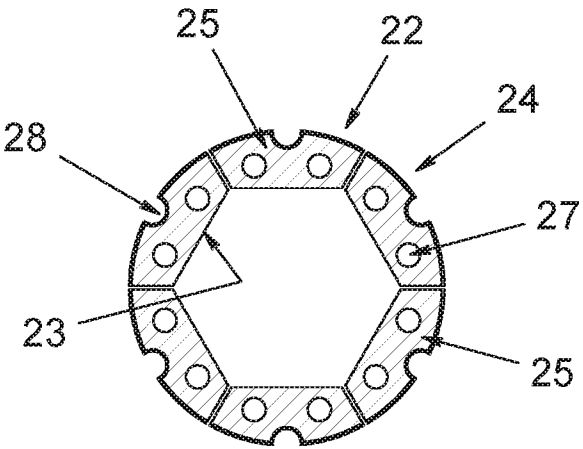
FIG. 3 is an isolated plan view of the locking collar of FIGS. 1A, 1B, and 2.
Figure 8:
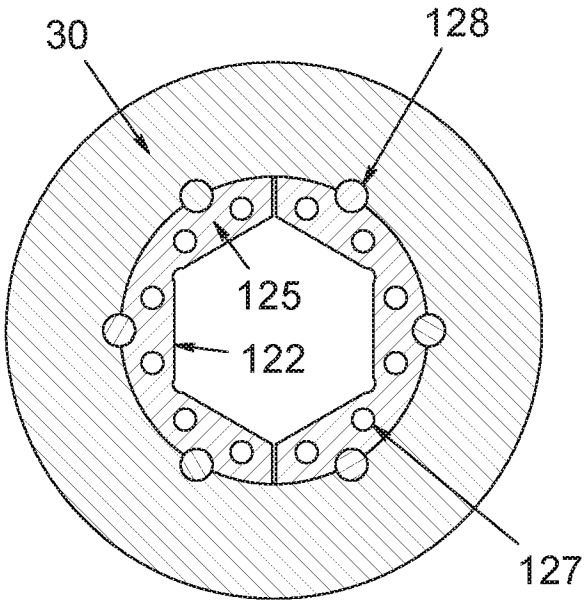
FIG. 8 is a modified embodiment of the cutting tool system including a two-piece split ring locking collar and a bit attachment member.
Figure 9:
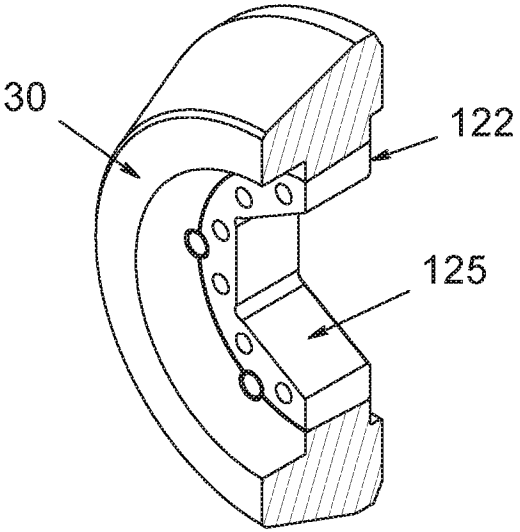
FIG. 9 is a perspective fragmented view of the modified embodiment of FIG. 8.
Figure 10:
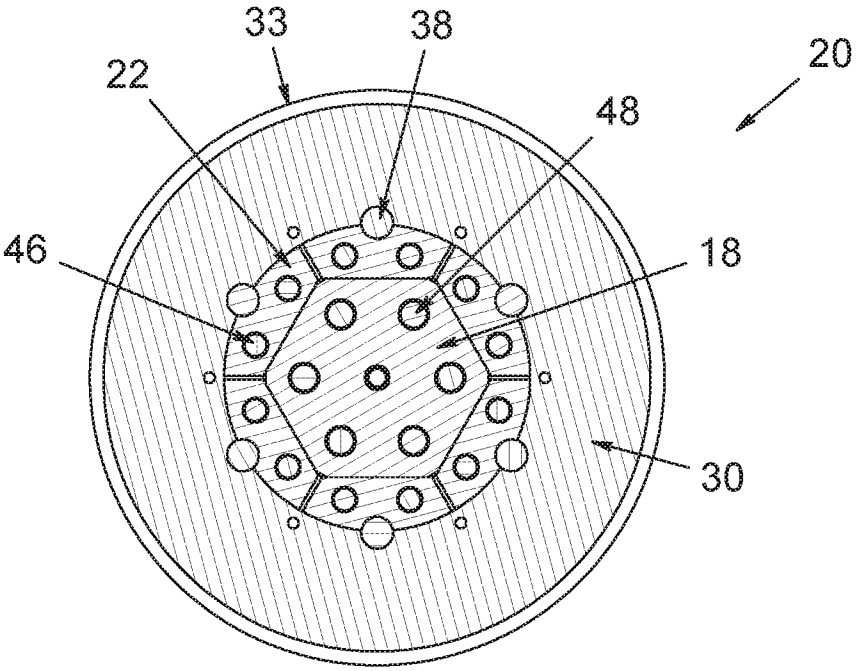
FIG. 10 is a cross-sectional view of the cutting tool system of FIG. 1 taken along sectional line 10-10 of FIG. 4.

As best shown in FIGS. 2 and 3, the locking collar 22 is a split ring comprising a plurality of discrete ring segments 25 that collectively establish the socket to circumscribe the head 18*a* and abut against the ledge 18*b* of the driving shaft 18. The larger dimensions of the ledge prevent the locking collar 22 from sliding from the head 18*a* along the length of the driving shaft 18. In the first illustrated embodiment, the plurality of discrete ring segments 25 comprises six discrete ring segments each extending end to end approximately 60 degrees. The ends of adjacent ring segments 25 are shown facing yet spaced apart from one another by relatively small gaps at each corner of the hexagon. The locking collar 22 may take other forms and may be composed of a different number of segments. For example, in the modified embodiment illustrated in FIGS. 8 and 9, a locking collar 122 comprises two discrete half ring segments 125 each extending end to end approximately 180 degrees. The segment ends are spaced apart from one another by relatively small gaps at opposite corners of the hexagon. As discussed in greater detail below, the gaps permit the locking collar 22/122 to compress radially inwardly, thereby tightening the grip of the locking collar 22 around the driving shaft 18. It should be understood that the locking collar 122 may include two, three, four, five, or other number of segments.

Each of the discrete ring segments 25/125 includes at least one fastener hole 27/127, and preferably a plurality of fastener holes 27/127. In the first embodiment, each of the discrete ring segments 25 includes two fastener holes 27 to provide a total of twelve fastener holes 27 circumferentially spaced from one another to define a ring, as best shown in FIG. 3. In the modified embodiment of FIGS. 8 and 9, each of the discrete ring segments 125 includes six fastener holes 127 to provide a total of twelve fastener holes 127 circumferentially spaced from one another to define a ring. It should be understood that each discrete ring segment, may include one, two, three, four, or other number of fastener holes.

Figure 1B:
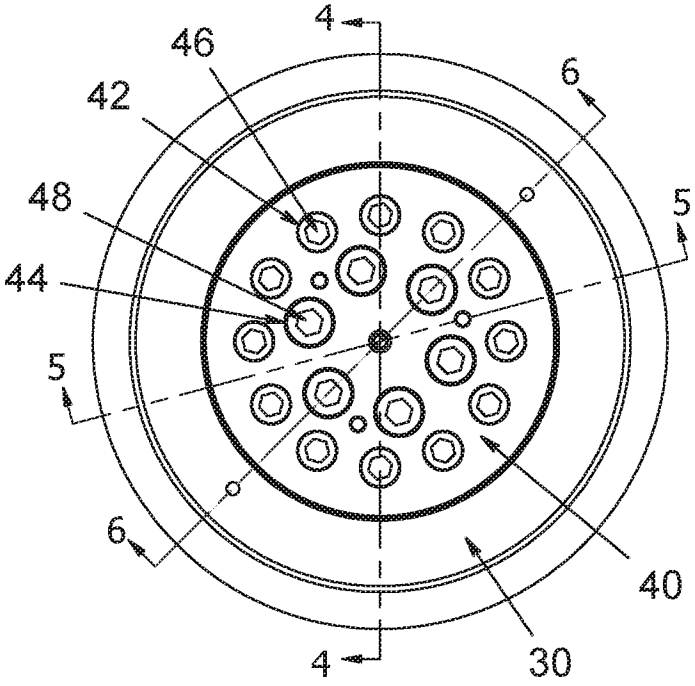
FIG. 1B is a front end view of the cutting tool system of FIG. 1A.

Referring again to FIGS. 1-3, the locking collar 22 has a radially outwardly facing outer surface 24 having at least one, and preferably a plurality of substantially longitudinally extending first grooves 28. The first grooves 28 have substantially semi-cylindrical, axially extending configurations. As best illustrated in FIGS. 1 and 2, each of the discrete ring segments 25 includes a single first groove 28 at its circumferential midpoint. In the modified embodiment of FIGS. 8 and 9, each of the discrete ring segments 125 includes a plurality (three) of first grooves 128. The first grooves 28/128 are circumferentially spaced from one another at common 60 degree intervals to define a ring pattern. It should be understood that each discrete ring segment 25/125 may include one, two, three, or more first grooves 28/128. Further, less than all of the ring segments 25/125 may include the first grooves 28/128. For example, a first groove may be formed in only one of the ring segments 25/125.

The radially outwardly facing outer surface 24 of the locking collar 22 gradually tapers in a longitudinal direction at a first tapering angle along at least a portion, more preferably the entirety, of the longitudinal length of the locking collar 22. The outer surface 24 is thereby frustoconical, with a first end of the locking collar 22 proximal to a retainer plate 40 (discussed below) being smaller in diameter than an opposite second end of the locking collar 22 distal to the retainer plate 40. The tapering angle may be, for example, about 1 to 5 degrees from perpendicular, although other angles may be practiced. Tapering of the outer surface 24 and other tapered surfaces discussed herein may be accomplished, for example, via machine operation.

The cutting tool system 20 further includes an annular bit attachment member 30 that is arranged concentrically outside of the locking collar 22. The bit attachment member 30 includes a radially inwardly facing inner surface 32 having substantially longitudinally extending second grooves 34. The second grooves 34 have substantially semi-cylindrical configurations, axially extending, and are circumferentially spaced from one another about the inner surface 32 to form a ring pattern. Each of the second grooves 34 is alignable with a corresponding first groove 28/128 of the locking collar 22/122 to establish the perimeter of a cylindrical pin receptacle. Pins 38 are longitudinally slidable into and out of the pin receptacles to prevent rotation of the locking collar 22/122 and the bit attachment member 30 relative to one another. While the embodiments illustrate six pins 38 positioned in six pin receptacles, it should be understood that the cutting tool system 20 may include one, two, three, four, five or another number of pin receptacles and pins 38.

Figure 4:
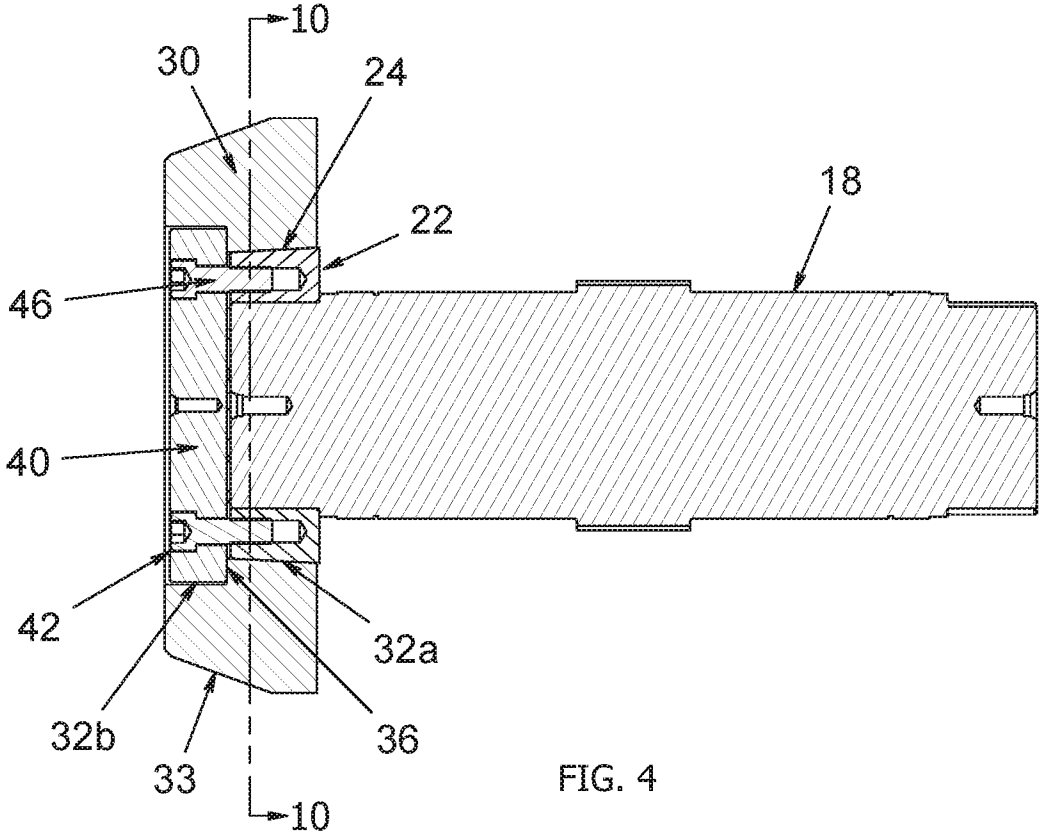
FIG. 4 is a cross section taken along the line 4-4 of FIG. 1B, with the cutting tool mated to the driving shaft.

As best shown in FIG. 4, the inner surface 32 includes a tapering first surface portion 32*a* that interfaces the tapering outer surface 24, a cylindrical second surface portion 32*b* for receiving the retaining plate 40, and an annular abutment shoulder 36 extending substantially perpendicular to and connecting the first and second surface portions 32*a*, 32*b*. The first surface portion 32*a* tapers at a second tapering angle that is approximately equal to the first tapering angle to receive and interface with the tapering outer surface 24 of the locking collar 22. The longitudinal length of the tapering first surface portion 32*a* is approximately equal to a longitudinal length of the locking collar 22. By setting the tapering angles of outer surface 24 and first surface portion 32*a* approximately equal to one another, stresses developed during use of the tool 20 are distributed along the length of the interface of the surfaces 24, 32*a* instead of being concentrated in any one traverse plane across the interface.

Figure 7A:
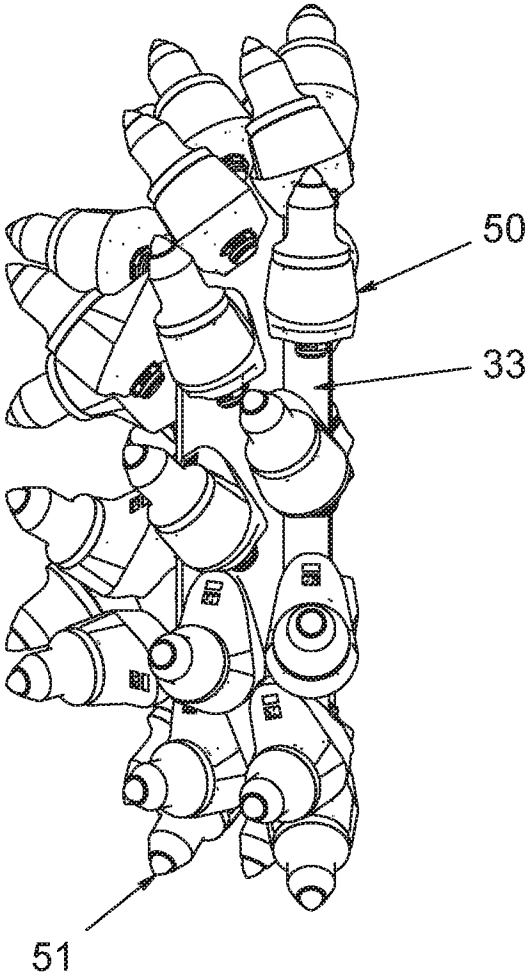
FIGS. 7A and 7B are simplified side perspective view and cross-sectional view of the cutting tool system of FIG. 1A showing cutting bits attached to the bit attachment member.
Figure 7B:
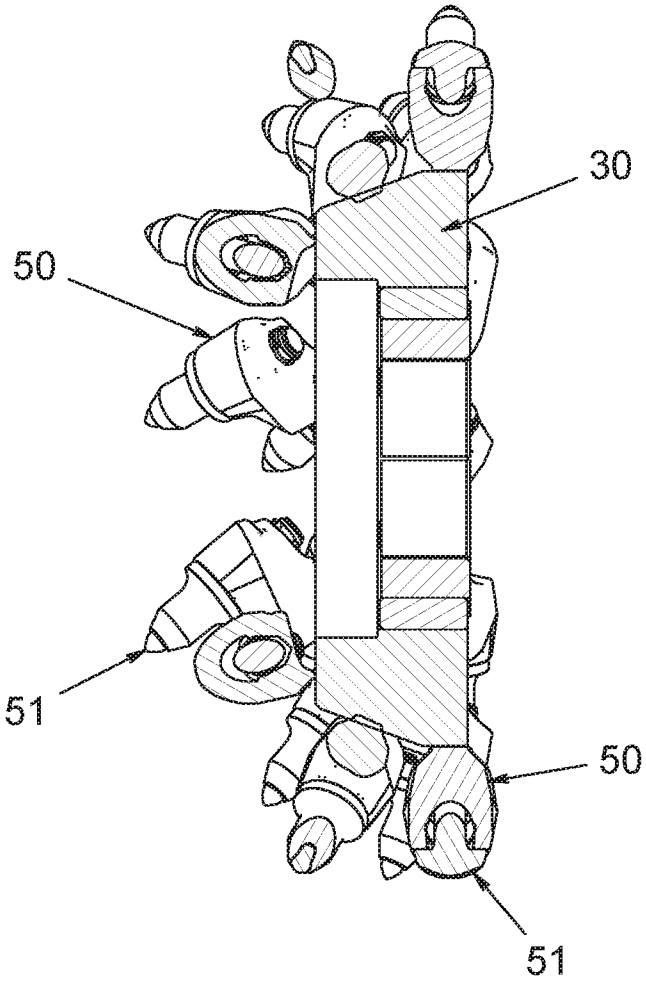

The bit attachment member 30 further includes a radially outwardly facing outer surface 33 that is shown tapering towards the front of the tool, i.e., towards the retaining plate 40. As best shown in FIG. 7A and FIG. 7B, rock cutting blocks 50 may be attached to the bit attachment member 30 along the outer surface 33. Such attachment may be accomplished, for example, by welding the cutting blocks directly the bit attachment member 30. Each of the cutting blocks 51 receives a rock cutting bit (e.g., hard inserts, picks) 51, such as by a fastener. By way of example, the rock cutting bit 51 may be made of tungsten carbide or other suitable materials. The rock cutting bits 51 illustrated in FIG. 7A and FIG. 7B are chosen for the purpose of description of an embodiment of the invention. Various other types of bits may be chosen and are compatible with the principles of the invention. Similarly, it should be understood that different bit arrangements (other than helical) may be employed, and that the outer surface 33 of the bit attachment member 30 may have alternative (e.g., non-tapered) shapes.

Figure 5:
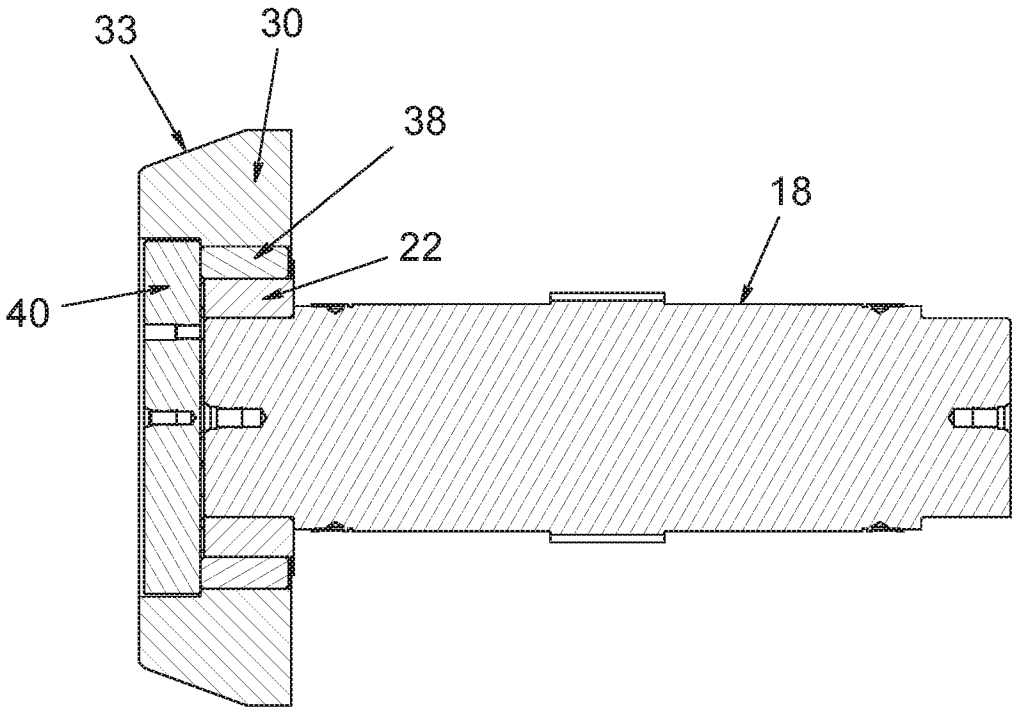
FIG. 5 is a cross section similar to FIG. 4 taken along a second sectional line 5-5 of FIG. 1B showing intersecting pin receptacles and pins of the cutting tool system.

The cutting tool system 20 further includes the retainer plate 40. The retainer plate 40 has a longitudinal length that is approximately equal to the longitudinal length of the cylindrical second surface portion 32*b*. The retainer plate 40 has a diameter that is larger than the diameter of the locking collar 22, yet slightly smaller than the diameter of the cylindrical second surface portion 32*b* to allow the retainer plate 40 to be snugly received in a cavity defined by the second surface portion 32*b*. The retainer plate 40 sits against the annular abutment shoulder 36. As best shown in FIG. 5, the retainer plate 40 sits over the pins 38 to maintain the pins 38 from sliding longitudinally out of their respective pin receptacles. The retainer plate 40 and other components of the system 20 may be made of steel (e.g., A36 or 4140 steel).

Figure 6:
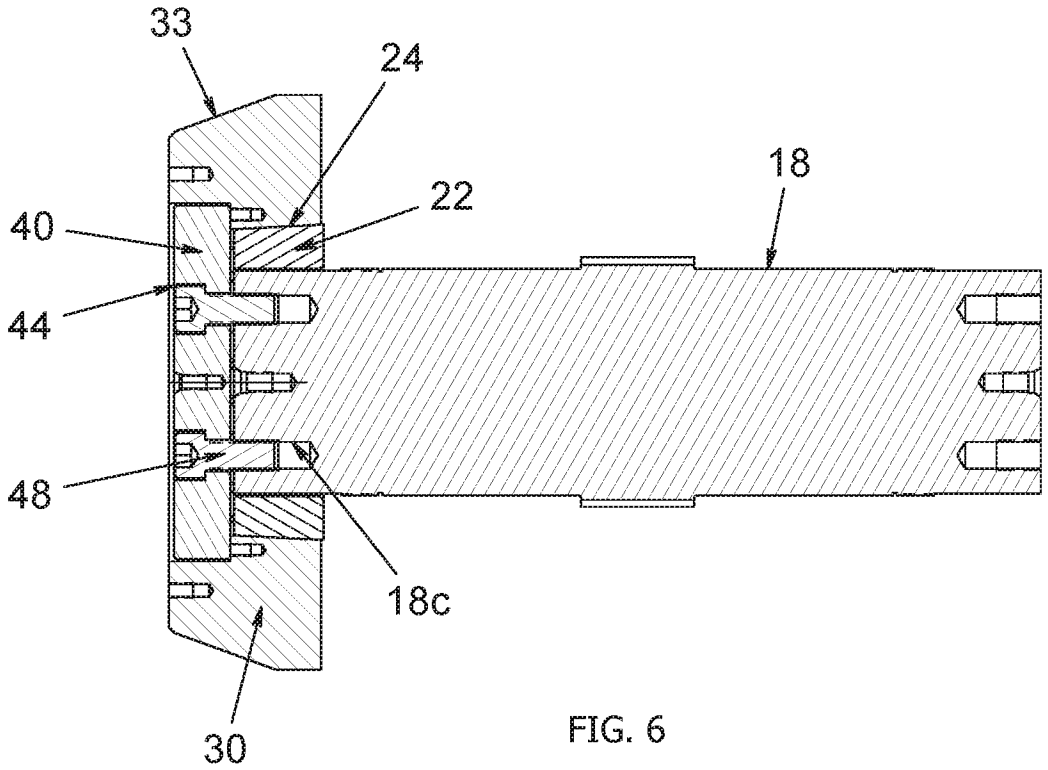
FIG. 6 is a cross section similar to FIG. 4 taken along a third sectional line 6-6 of FIG. 1B intersecting second fastener holes of the retainer plate and fastener holes of the driving shaft.

The retainer plate 40 includes radially outer first fastener holes 42 and radially inner second fastener holes 44, each of which extends longitudinally through the thickness of the retainer plate 40. The radially outer first fastener holes 42 align with the fastener holes 27 of the locking collar 22. First fasteners 46 are constructed to engage the first fastener holes 42 and the aligned fastener holes 27 to secure the retainer plate 40 to the locking collar 22. The inner second fastener holes 44 align with fastener holes 18*c* (FIG. 6) in the end of the head 18*a* of the driving shaft 18. The fastener holes 18*c* extend longitudinally into the head 18*a* of the driving shaft 18. In the illustrated embodiment, six fastener holes 18*c* are provided in a rectangular pattern. Second fasteners 48 are constructed to engage the second fastener holes 44 and the aligned fastener holes 18*c* to secure the retainer plate 40 to the driving shaft 18. When fastened in place, the retainer plate 40 sits against the abutment shoulder 26, thereby retaining the bit attachment member 30 in place with its tapering first surface portion 32*a* abutting against tapering outer surface 24.

Screws, bolts, or any other suitable fastener or combination of fasteners may be used as the first and second fasteners 46, 48. Fasteners may be made of hardened steel.

Referring principally to FIG. 4, tightening of the fasteners 46, 48 causes the retainer plate 40 to be driven against the abutment shoulder 36 of the bit attachment member 30 to the right. As the tapering first surface portion 32*a* slides across the tapering outer surface 24, the first surface portion 32*a* imparts a wedging action to the interfacing tapering outer surface 24. In the illustrated embodiments, in which the locking collars 22/122 are multi-member split ring collars, the wedging action between the interfacing surfaces compresses the locking collar 22 to increase the clamping force of the locking collar 22 about the head 18*a* of the driving shaft 18. The increased clamping force prevents rocking motion between the locking collar 22 and the bit attachment member 30 during drilling.

Assembly of the cutting tool system 20 may be accomplished by fitting the locking collar 22 into one end (to the right side in FIG. 1A) of the bit attachment member 30 so that the first grooves 28 are aligned with the second grooves 34. Pins 38 are inserted from the same end into the pin receptacles formed by the grooves 28, 34 to lock the rotational position of the locking collar 22 relative to the bit attachment member 30. The retainer plate 40 is inserted into the locking collar 22 from the opposite end (to the left side in FIG. 1A) until the retainer plate 40 sits against the abutment shoulder 36. The rock cutting blocks 50 may be pre-applied, such as by welding, to the outer surface 33 of the bit attachment tool. The pre-assembly of the locking collar 22, the bit attachment member 30, and the pins 38 is fitted on the head 18*a* of the driving shaft.

The radially outer first fastener holes 42 are aligned with the fastener holes 27 of the locking collar 22, and the first fasteners 46 are inserted into the first fastener holes 42 and the aligned fastener holes 27 to secure the retainer plate 40 to the locking collar 22. The inner second fastener holes 44 are aligned with the fastener holes 18*c* in the end of the head 18*a* of the driving shaft 18, and the second fasteners 48 are inserted into the second fastener holes 44 and the aligned fastener holes 18*c* to secure the retainer plate 40 to the driving shaft 18. When fastened in place, the retainer plate 40 sits against the abutment shoulder 26, thereby retaining the bit attachment member 30 in place with its tapering first surface portion 32*a* abutting against tapering outer surface 24. As the fasteners 46, 48 are tightened, the retainer plate 40 is driven against the abutment shoulder 36 of the bit attachment member 30 to slide the tapering first surface portion 32*a* relative to the tapering outer surface 24. The first surface portion 32*a* thereby imparts a wedging action to the interfacing tapering outer surface 24, compressing the locking collar 22 to increase the clamping force of the locking collar 22 about the head 18*a* of the driving shaft 18. The increased clamping force created by tightening the fasteners 42, 44 prevents rocking motion between the locking collar 22 and the bit attachment member 30 during drilling.

It should be understood that the above method is provided by way of example, and that the cutting tool system 20 may be assembled and connected to the rotating shaft 18 in sequences other than that described above.

The cutting tool system 20 may be used for industrial applications such as mining, excavating, and tunneling applications using known techniques with the inventive system described herein. For example, the cutting tool system 20 may be used for excavation of foundations, demolition of concrete, and excavation of rock and mineral formations. The cutter heads may have outer diameters on the order of, for example, about 4 inches to 50 inches, and a depth of about 2 inches to 36 inches. Other applications are also possible.

Although the description illustrates and describes sockets and shafts with hexagonal shaped configurations, applying the principles of the invention to square or other polygonal shaped configurations is also within the scope of the invention.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A cutting tool system, comprising:

a locking collar having a socket configured to mate with a driving shaft in locking engagement to prevent relative rotational movement between the locking collar and the driving shaft, the locking collar being compressible radially inwardly and having a radially outwardly facing outer surface tapering in a longitudinal direction along at least a portion thereof at a first tapering angle;

a bit attachment member having a radially inwardly facing inner surface tapering along at least a portion thereof at a second tapering angle that is approximately equal to the first tapering angle to interface with the outer surface of the locking collar;

a retainer plate; and fasteners constructed to secure the retainer plate directly to the locking collar and to the driving shaft, and to impart a wedging action between the tapering outer surface and the tapering inner surface that causes inward compression of the locking collar.

2. The cutting tool system of claim 1, wherein the fasteners comprise:

first fasteners constructed to secure the retainer plate to the locking collar through first fastener holes in the retainer plate and fastener holes in the locking collar; and second fasteners constructed to secure the retainer plate to the driving shaft through second fastener holes in the retainer plate and fastener holes in the driving shaft.

3. The cutting tool system of claim 2, wherein the radially inwardly facing inner surface tapers along a tapering first surface portion thereof and extends longitudinally along a second surface portion thereof, the second surface portion having a diameter larger than a diameter of the retainer plate, the radially inwardly facing inner surface further comprising a radially extending abutment shoulder between the tapering first surface portion and the longitudinally extending second surface portion.

4. The cutting tool system of claim 3, wherein a longitudinal length of the tapering first surface portion is approximately equal to a longitudinal length of the locking collar, wherein a longitudinal length of the second surface portion is approximately equal to a longitudinal length of the retainer plate, and wherein the retainer plate is seatable on the abutment shoulder so as to be circumscribed by the second surface portion.

5. The cutting tool system of claim 1, wherein the locking collar comprises a split ring comprising a plurality of discrete ring segments that are collectively circumscribable about the driving shaft.

6. The cutting tool system of claim 5, wherein the plurality of discrete ring segments comprises six discrete ring segments each extending end to end approximately 60degrees.

7. The cutting tool system of claim 1, wherein the socket of the locking collar is hexagonal in shape to mate with a hexagonal shape of the driving shaft.

8. The cutting tool system of claim 1, further comprising cutting bits secured directly to a radially outwardly facing outer surface of the bit attachment member.

9. A cutting tool system, comprising:

a locking collar having a socket configured to mate with a driving shaft in locking engagement to prevent relative rotational movement between the locking collar and the driving shaft, the locking collar being compressible radially inwardly and having a radially outwardly facing outer surface tapering in a longitudinal direction along at least a portion thereof at a first tapering angle, the outer surface comprising a substantially longitudinally extending first groove;

a bit attachment member having a radially inwardly facing inner surface tapering along at least a portion thereof at a second tapering angle that is approximately equal to the first tapering angle to receive and interface with the outer surface of the locking collar, the inner surface comprising a substantially longitudinally extending second groove that is alignable with the first groove so that the first and second grooves together form a perimeter of a pin receptacle;

a pin insertable into the pin receptacle to prevent rotation of the locking collar and the bit attachment member relative to one another;

a retainer plate; and fasteners constructed to secure the retainer plate directly to the locking collar and to the driving shaft, and to impart a wedging action between the tapering outer surface and the tapering inner surface that causes inward compression of the locking collar.

10. The cutting tool system of claim 9, wherein the fasteners comprise:

first fasteners constructed to secure the retainer plate to the locking collar through first fastener holes in the retainer plate and fastener holes in the locking collar; and second fasteners constructed to secure the retainer plate to the driving shaft through second fastener holes in the retainer plate and fastener holes in the driving shaft.

11. The cutting tool system of claim 10, wherein the radially inwardly facing inner surface tapers along a tapering first surface portion thereof and extends longitudinally along a second surface portion thereof, the second surface portion having a diameter larger than a diameter of the retainer plate, the radially inwardly facing inner surface further comprising a radially extending abutment shoulder between the tapering first surface portion and the longitudinally extending second surface portion.

12. The cutting tool system of claim 11, wherein a longitudinal length of the tapering first surface portion is approximately equal to a longitudinal length of the locking collar, wherein a longitudinal length of the second surface portion is approximately equal to a longitudinal length of the retainer plate, and wherein the retainer plate is seatable on the abutment shoulder so as to be circumscribed by the second surface portion.

13. The cutting tool system of claim 12, wherein the first groove of the locking collar comprises a plurality of circumferentially spaced semi-cylindrical first grooves, wherein the second groove of the bit attachment member comprises a plurality of circumferentially spaced semi-cylindrical second grooves, wherein the pin receptacle comprises a plurality of circumferentially spaced cylindrical pin receptacles, wherein the first and second grooves are alignable to establish the plurality of circumferentially spaced cylindrical pin receptacles, and wherein said pin comprises a plurality of cylindrical pins insertable into respective ones of the pin receptacles to prevent rotation of the locking collar and the bit attachment member relative to one another.

* * * * *